US010343265B2

(12) United States Patent
Daly

(10) Patent No.: US 10,343,265 B2
(45) Date of Patent: Jul. 9, 2019

(54) REVERSIBLE PLANETARY GEAR SCREW DRIVER

(71) Applicant: JACK INNOVATIONS, LLC, Laurel, MD (US)

(72) Inventor: Kendrick Daly, Laurel, MD (US)

(73) Assignee: JACK INNOVATIONS, LLC, Laurel, MD (US)

( * ) Notice: Subject to any disclaimer, the term of this patent is extended or adjusted under 35 U.S.C. 154(b) by 212 days.

(21) Appl. No.: 15/503,795

(22) PCT Filed: Aug. 18, 2015

(86) PCT No.: PCT/US2015/045614
§ 371 (c)(1),
(2) Date: Feb. 14, 2017

(87) PCT Pub. No.: WO2016/028727
PCT Pub. Date: Feb. 25, 2016

(65) Prior Publication Data

US 2017/0239791 A1 Aug. 24, 2017

Related U.S. Application Data

(60) Provisional application No. 62/038,885, filed on Aug. 19, 2014.

(51) Int. Cl.

| | |
|---|---|
| ***B25B 17/02*** | (2006.01) |
| ***B25B 23/00*** | (2006.01) |
| ***B25B 15/02*** | (2006.01) |
| ***B25B 17/00*** | (2006.01) |

(52) U.S. Cl.
CPC ..... *B25B 17/02* (2013.01); *B25B 15/02* (2013.01); *B25B 17/00* (2013.01); *B25B 23/0007* (2013.01)

(58) Field of Classification Search
CPC ..... B25B 17/00; B25B 17/02; B25B 15/02; B25B 23/0007
See application file for complete search history.

(56) References Cited

U.S. PATENT DOCUMENTS 6,012,359 A * 1/2000 Lin ..... F16H 1/28 81/57.12
9,138,876 B2 * 9/2015 Cullison ..... B25B 17/00

* cited by examiner

*Primary Examiner* — David B. Thomas
(74) *Attorney, Agent, or Firm* — J.A. Lindeman & Co. PLLC; Joseph Parisi; Jeffrey Lindeman

(57) ABSTRACT

A reversible planetary gear driver tool drives and removes fasteners and includes a first driving block, a planetary gear system, and a second driving block. The tool provides a speed advantage configuration and a torque advantage configuration. In the speed advantage configuration, a handle engages with the first driving block and a bit engages with the second driving block. Rotation of the casing is prevented. The first driving block rotates at a first input speed, and the tool converts the first input speed to a faster second output speed of the second driving block. In the torque advantage configuration, the casing is reversed and the handle engages with the second driving block and the bit engages with the first driving block. As the second driving block rotates at a first input torque, the tool converts the first input torque to a higher output torque of the first driving block.

14 Claims, 20 Drawing Sheets

REVERSIBLE PLANETARY GEAR SCREW DRIVER

CROSS-REFERENCE TO RELATED APPLICATIONS

This application claims the benefit of priority of U.S. Provisional Application No. 62/038,885 filed on Aug. 19, 2014. The entire contents of U.S. Provisional Application No. 62/038,885 filed on Aug. 19, 2014, are incorporated by reference.

TECHNICAL FIELD

This technology relates to screwdriver systems and methods of driving screws. More particularly, the technology relates to systems, devices, and methods of driving mechanical fasteners using a planetary gear-driven screwdriver to provide improved torque and speed.

BACKGROUND

The traditional screwdriver is a hand driven tool that consists of a handle attached to a shank that typically tapers to a tip that fits into a slotted head of a screw. A user applies torque to the handle, and the torque is transferred through the handle and shank to turn the head of the screw, which drives the screw into a given medium. Traditional screwdrivers provide little to no mechanical advantage in terms of speed and torque. Some screw drivers include a ratcheting mechanism that restricts the output rotation of the shaft to one direction, which in return provides a speed advantage over traditional screwdrivers. Other screwdrivers provide gearing on top of the ratcheting mechanism to provide an even larger speed advantage. To provide an advantage in torque, typically the geometry of the handle is altered to provide a lever advantage. Prior attempts to provide a convenient, inexpensive, and safe hand-driven screwdriver device that provides increased driving speed and torque have not provided a satisfactory solution.

SUMMARY

The claimed invention provides a planetary gear screwdriver that provides improved speed and torque over previous devices. In one example embodiment, the invention provides the user with three operational modes. The first mode provides the user with a speed advantage over conventional screwdrivers. The second mode provides the user with a torque advantage, and the third mode allows the user to operate the screwdriver with a traditional one-to-one mechanical advantage.

The configuration of the input and output attachments provide a speed advantage in one configuration and a torque advantage in another configuration. A user changes the configuration depending upon the particular use and the type of mechanical advantage desired. The invention includes a speed advantage configuration and a torque advantage configuration to provide improved performance. In the speed advantage configuration, a handle is attached to a first driving block, which turns and rotates a planetary gear system. The first driving block is attached to the planetary gear system and functions as a planetary carrier, which rotates the planetary gear system to provide an increased rotational speed to an accessory bit via a second driving block. To change from the speed advantage configuration to the torque advantage configuration, the user reverses the handle and the accessory bit, attaching the handle to the second driving block and attaching the accessory bit to the first driving block. When the user turns the handle in the reversed configuration, the handle rotates the second driving block, which turns the planetary gear system and rotates the planetary carrier of the first driving block with a higher torque output, which is imparted to the bit accessory.

The claimed invention comprises a planetary gear system housed inside of a casing, which couples the first driving block and second driving block used for input and/or output attachments. Input and output attachments can include handles and bits, respectively, as well as T-handles, socket drives—including quarter-inch drives, three-eighths inch drives, half-inch drives, and other socket drives, as well as drill bit attachments and other rotational drive accessories. The planetary gear system is comprised of a sun gear, planet gears, a planetary carrier, and a ring gear. The first driving block is configured and manufactured to function as the planetary carrier. The configuration of the screwdriver determines the mode of operation and the type of mechanical advantage that it provides. The reversible planetary screwdriver of the claimed invention provides alternate functionalities, such that when the handle or input attachment is coupled with the first driving block, and the bit or output attachment is coupled to the second driving block, the screwdriver of the claimed invention provides a speed advantage. To provide a torque advantage, the handle or input attachment is reversed and coupled with the second driving block, and the bit or output attachment is coupled to the first driving block. The reversibility and alternate speed and torque advantage in a single screwdriver provides many advantages over conventional systems.

In one example embodiment of the claimed invention, a reversible planetary gear driver tool for driving and removing fasteners includes a first driving block, a planetary gear set, and a second driving block. The first driving block includes a locking flange and an accessory insert. The accessory insert can be configured to receive a handle or a bit. The accessory insert can include an output shaft configured to extend longitudinally from the accessory insert or from the accessory bit insert and configured to receive a bit attachment.

The planetary gear is in cooperation with the first driving block and can move simultaneously with the first driving block. The planetary gear set includes a ring gear with an inner diameter and gear teeth disposed on an inside surface of the ring gear. The planetary gear set also includes a sun gear positioned in substantially the center of the ring gear. The sun gear has an exterior diameter and gear teeth disposed on an outside surface. The planetary gear set can also include a sun gear shaft in cooperation with the sun gear and extending from the sun gear to the bit accessory insert in the second driving block.

The planetary gear set also includes one or more planetary gears positioned within the ring gear. The planetary gear(s) engage(s) the gear teeth of the ring gear and the gear teeth of the sun gear. The first driving block can be manufactured and configured to operate as a planetary gear carrier that operates in cooperation with the planetary gear(s) and transfers rotational motion through the planetary gear set. As a planetary carrier, the first driving block extends from the planetary gear system to the accessory insert.

The reversible planetary gear driver tool can also include a support disk in cooperation with the planetary gear set. The support disk can include one or more fasteners configured to attach the support disk to the planetary gear set.

The reversible planetary gear driver tool also includes a second driving block. The second driving block can include a locking flange and a bit accessory insert, and the bit accessory insert can be configured to receive the bit or the handle. The bit attachment can include a slot head screw driver, a Phillips head screw driver, a square drive attachment, a hex drive attachment, a six-point star-shaped pattern drive attachment, and the like.

The reversible planetary gear driver tool also includes a casing configured to couple the first driving block, the planetary gear system, and the second driving block. The casing includes a first rib that supports the first driving block, a second rib that supports the second driving block, and a middle rib that supports the ring gear such that when the casing is closed, the ring gear is grounded.

In the reversible planetary gear driver tool of the claimed invention, when a handle is engaged with the accessory insert of the first driving block and a bit is engaged with the bit accessory insert of the second driving block and the casing is prevented from rotating, the first driving block is rotated at a first speed, and the reversible driving tool converts the first speed of the first driving block to a faster second speed of the second driving block.

When the casing is reversed and the handle is engaged with the bit accessory insert of the second driving block, and the bit is engaged with the accessory insert of the first driving block, and the second driving block is rotated at a first torque, the reversible driving tool converts the torque of the second driving block to a higher torque of the first driving block.

The planetary gear driver tool can also include a locking pin extending from the second driving block, where the locking pin is configured to lock the planetary gear set in an in-position and configured to allow the planetary gear set to rotate when positioned in an out-position. The support disk can include a locking pin through-hole configured to receive the locking pin when the locking pin is in the in-position. Similarly, the casing can include a locking pin casing through-hole configured to receive the locking pin when the locking pin is in the in-position.

The planetary gear driver tool can also include a handle including an input insert configured to be received by the accessory insert of the first driving block. The handle can also include a locking pin recess, where the locking pin recess is configured to receive a flange tip of the locking pin. The handle includes a T-shaped grip. The handle can also include a longitudinal cavity configured to reversibly receive the first driving block to provide a speed advantage configuration of the planetary gear driver tool or the handle can receive the second driving block to provide a torque advantage configuration of the planetary gear driver tool. The input insert can be positioned substantially in the center of the longitudinal cavity of the handle.

DESCRIPTION OF REFERENCE NUMERALS AND COMPONENT SYMBOLS

Figure 1A:
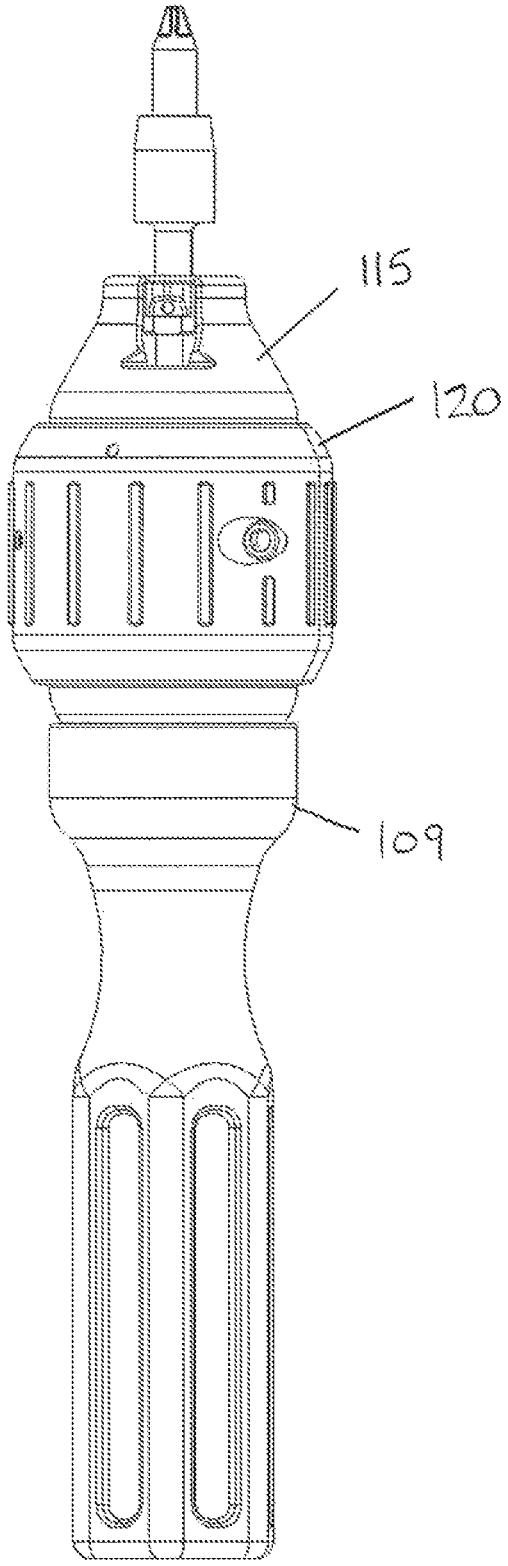
FIG. 1A is a front view of an assembled planetary gear screwdriver in accordance with the claimed invention.

101: Ring gear
102: Locking pin
103: Sun gear
104: Sun gear shaft
105: Support disk
106: Locking pin through-hole on support disk 105
107: Screw through-hole on support disk 105
108: Support shaft through-hole on support disk 105
109: First driving block
110: Accessory insert on first driving block 109
111: Screw bore on first driving block 109
112: Sun gear shaft bore on first driving block 109
113: Support shaft bore
114: Locking flange on first driving block 109
115: Second driving block
116: Sun gear shaft bore on second driving block 115
117: Locking pin bore
118: Accessory insert on second driving block 115
119: Locking flange on second driving block 115
120: Casing
121: Locking pin through-hole on casing 120
122: First rib supporting first driving block 109

123: Second rib supporting second driving block 115
124: Middle rib
125: Alignment bore
126: Alignment boss
127: Handle accessory
128: Bit accessory
129: Male insert
130: Support shaft
131: Support fastener
132: Casing fastener
133: Planetary gear
134: Set Screw on second driving block 115
135: Ring gear lock
178: Top face (on support disk 105)
210: Core assembly
1022: Flange tip (on locking pin 102)
1033: Bore (on sun gear 103)
1088: Indents (on ring gear 101)
1099: Internally positioned teeth (on ring gear 101)
1109: bottom face (of first driving block 109)
1212: bottom face (of second driving block 115)

DETAILED DESCRIPTION

One embodiment of the screwdriver of the present invention includes a planetary gear assembly, a first driving block, and a second driving block that provides greater torque and speed of operation than previous screwdrivers. The increased torque allows users a wider range of applications and results in less fatigue. The increased speed of operation allows users to complete their tasks more efficiently.

The screwdriver of the claimed invention includes a first driving block and second driving block that are switchably configured as an input drive and an output drive depending upon the desired use or application. In a speed advantage (slow input speed-fast output speed) configuration, a handle is attached to the first driving block, which turns and rotates a planetary gear system. The rotating planetary gear system provides an increased rotational speed to an accessory bit via the second driving block. To change from the speed advantage (slow input speed-fast output speed) configuration to the torque advantage (low torque input-high torque output) configuration, the user reverses the first driving block and second driving block so that the handle is now attached to the second driving block and the first driving block is attached to the bit accessory. When the user turns the handle, the handle rotates the second driving block, which turns the planetary gear system and rotates the first driving block with a higher torque output, which is imparted to the bit accessory.

Figure 26:
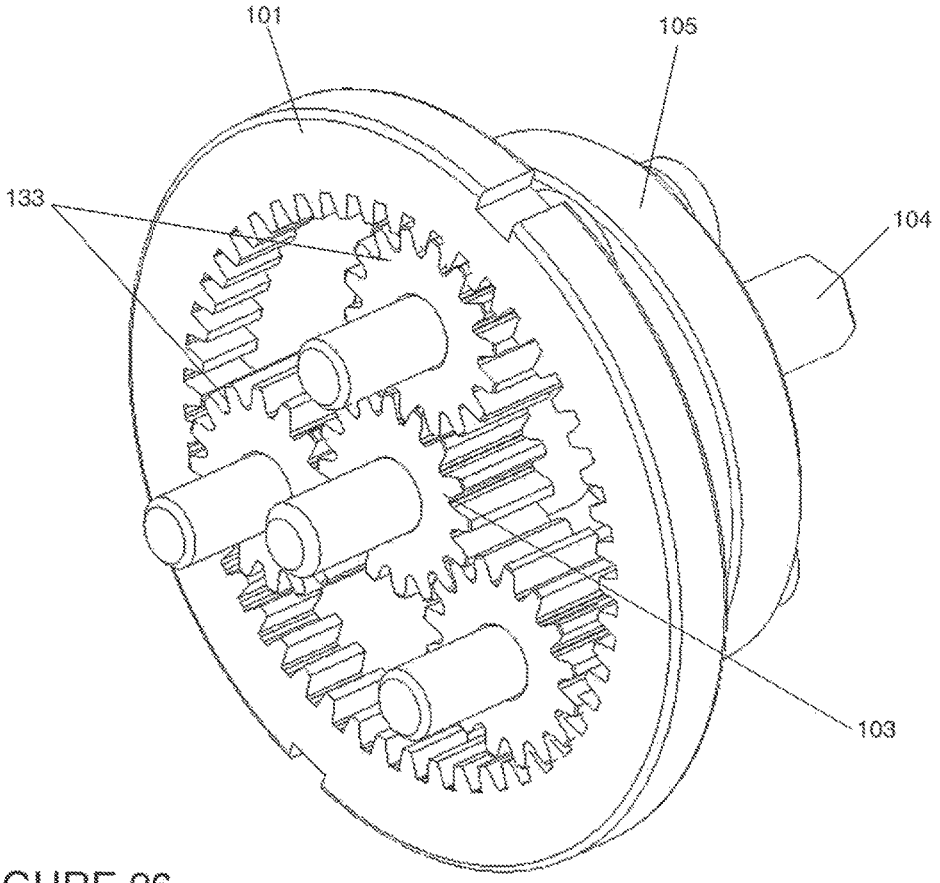
FIG. 26 is a perspective view of the internal gearing of a screwdriver in accordance with the claimed invention.

As shown in FIG. 1A, in one example embodiment, major components of the present invention include casing 120, first driving block 109, and second driving block 115. Additionally, ring gear 101, sun gear 103, and planetary gears 133 are shown in FIG. 26, for example. Other components cooperate with these items to provide benefits over conventional screwdrivers. In one example embodiment, the screwdriver of the claimed invention provides a sophisticated planetary gear system along with a first driving block and second driving block to provide improved performance.

Figure 27:
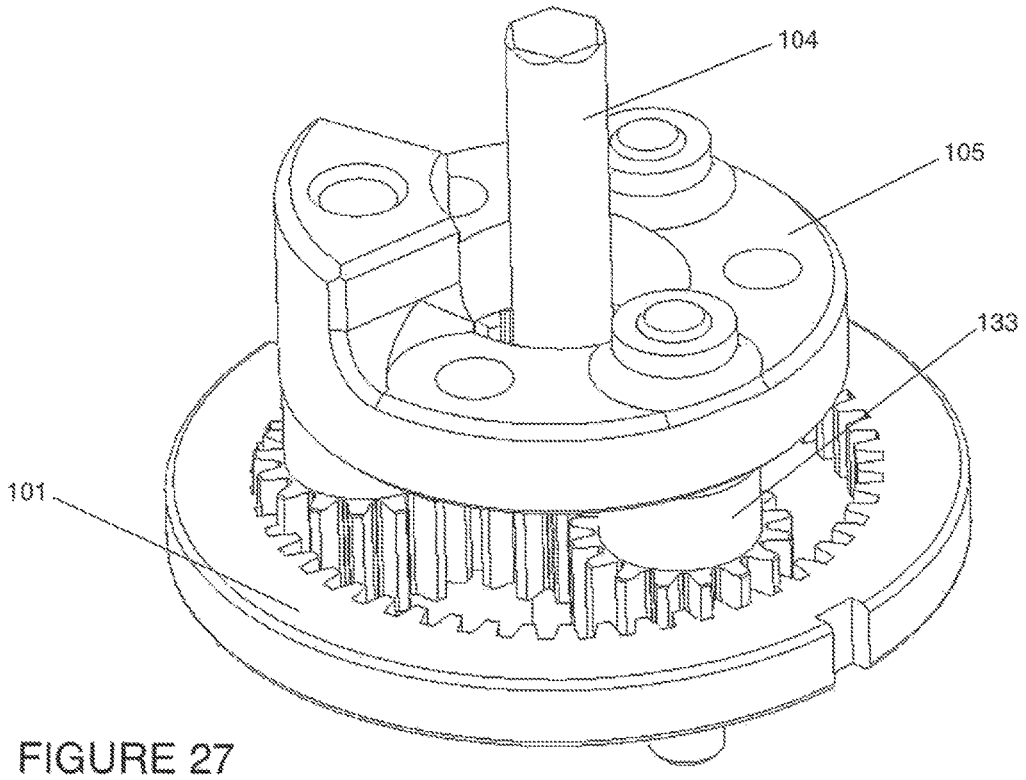
FIG. 27 is a perspective view of support disk 105 supporting the planetary gears 133.

The planetary gear system (including ring gear 101, sun gear 103, and planetary gears 133 shown in FIGS. 26, 27) can provide several different gear ratios depending on which components are grounded, which components are configured as an input, and which components are configured as an output. The planetary gear system is comprised of a ring gear 101, sun gear 103, three planet gears 133, and planetary carrier (first driving block 109) shown in FIG. 19, for example. The first driving block 109 is configured and manufactured as a planetary carrier and also supports the set of planet gears 133 and provides the transmission of their unified rotation. The screwdriver of the claimed invention operates with the ring gear 101 grounded, that is immobilized. With the ring gear 101 grounded, the gear ratio either provides an increase in speed or an increase in torque, depending upon which driving block is configured as an input and which driving block is configured as an output. When the first driving block 109 (planetary carrier) provides the input in the system, the sun gear 103 provides the output at the second driving block at an increased speed. When the sun gear 103 provides the input (i.e., that is, the second driving block 115), the planetary carrier provides the output to the accessory bit at an increased torque.

To switch between the slow input speed-fast output speed configuration to the low torque input-high torque output configuration, a user reverses the first driving block 109 and the second driving block 115. That is, the user detaches the handle accessory 127 from the first driving block 109 and detaches the bit accessory 128 from the second driving block 115. The handle accessory 127 is then attached to the second driving block 115 and the bit accessory 128 is then attached to the first driving block 109. Likewise, to switch between the low torque input-high torque output configuration to the slow input speed-fast output configuration, a user detaches the handle accessory 127 from the second driving block 115 and detaches the bit accessory 128 from the first driving block 109. The handle accessory 127 is then attached to the first driving block 109 and the bit accessory 128 is then attached to the second driving block 125.

Figure 15:
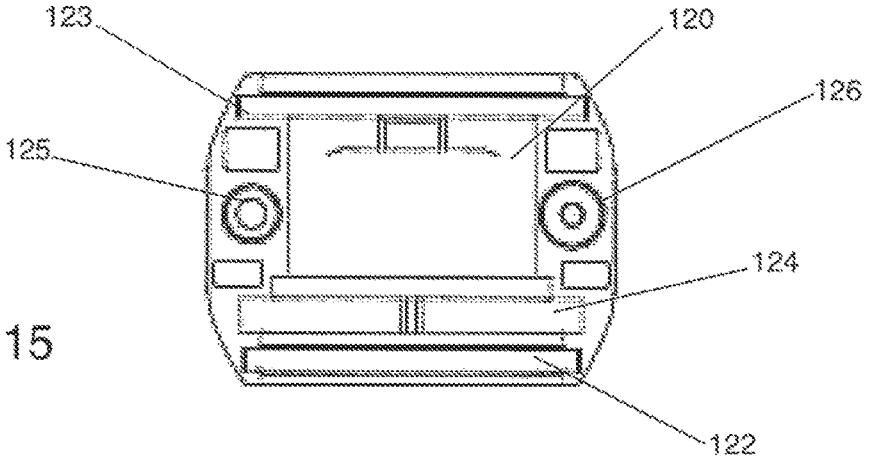
FIG. 15 is an internal side view of casing half 120.
Figure 17:
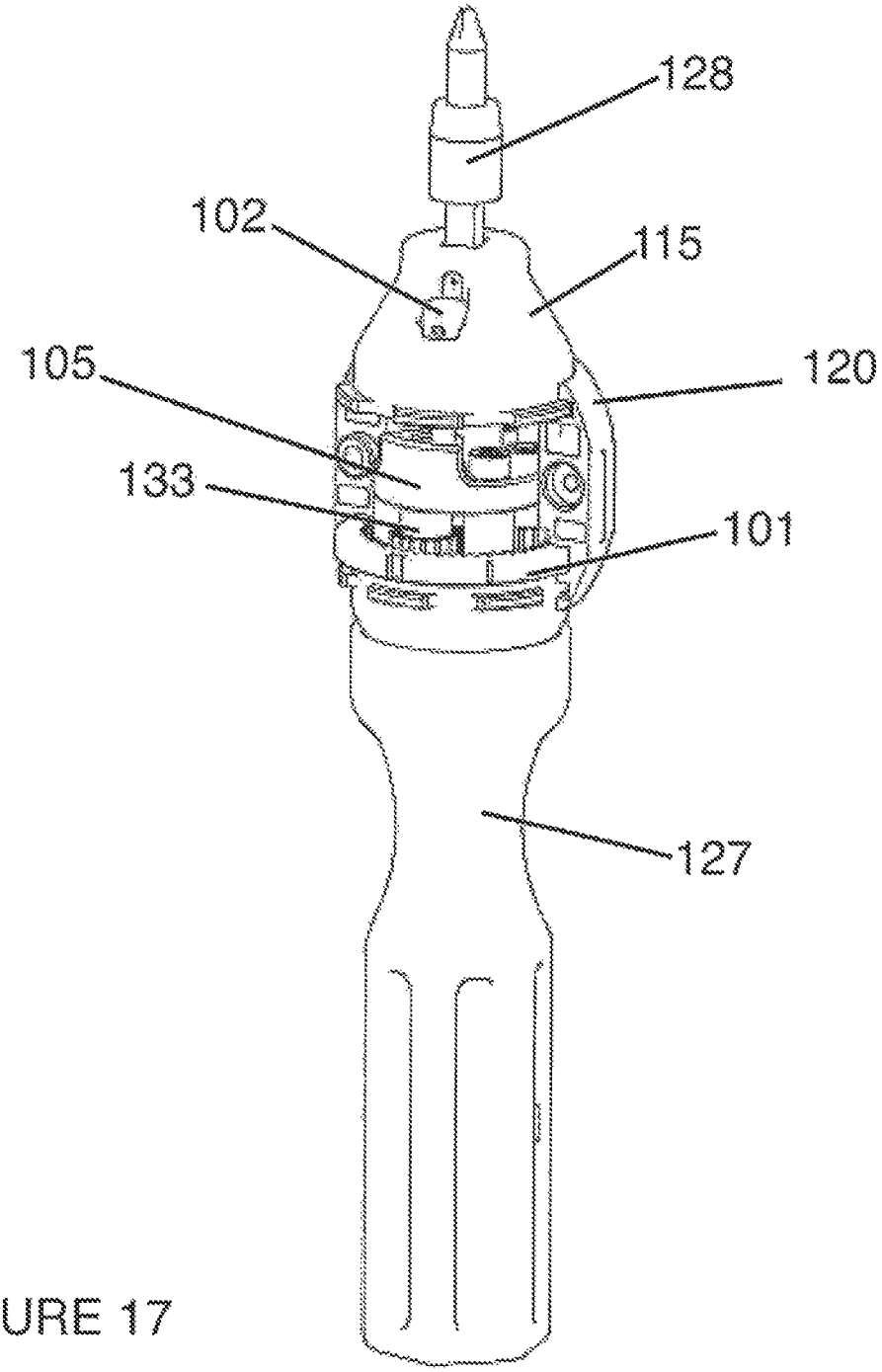
FIG. 17 is an assembly view of an example screwdriver in accordance with the claimed invention with internal gearing exposed.
Figure 20:
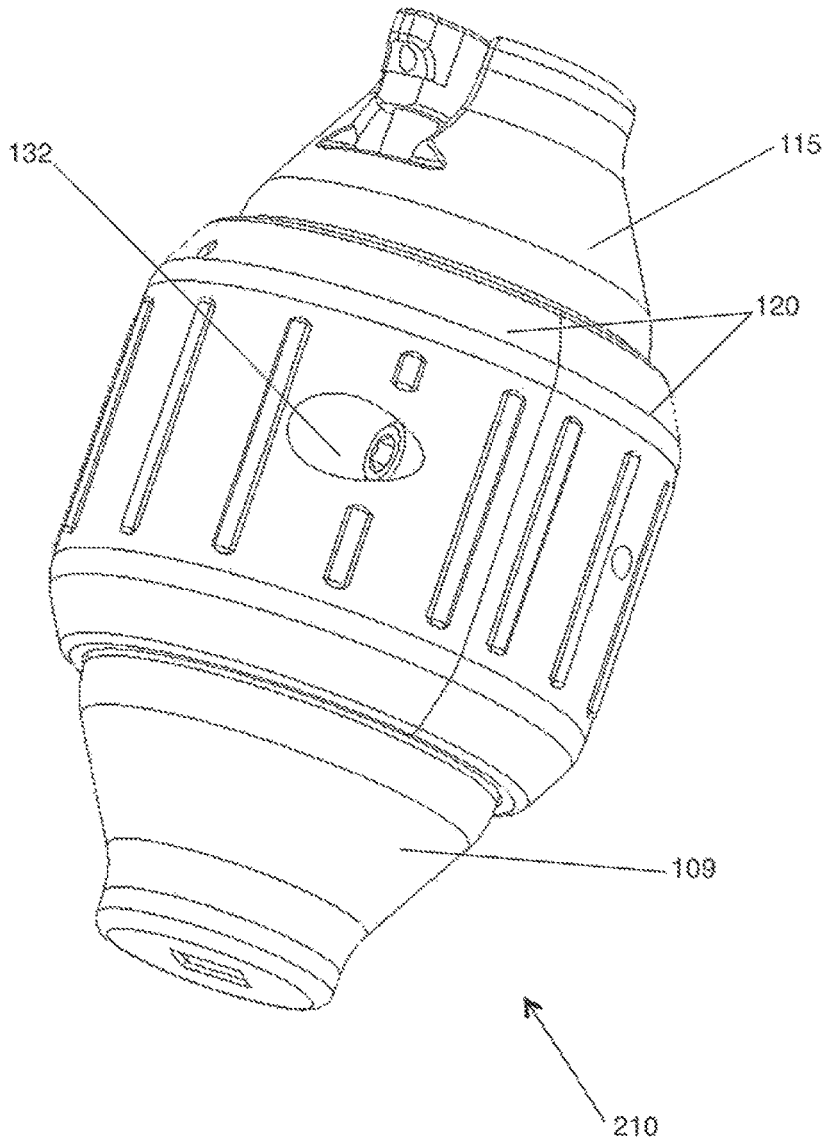
FIG. 20 is an assembly view of casing halves 120, first driving block 109, and second driving block 115 without accessory attachments.
Figure 22:
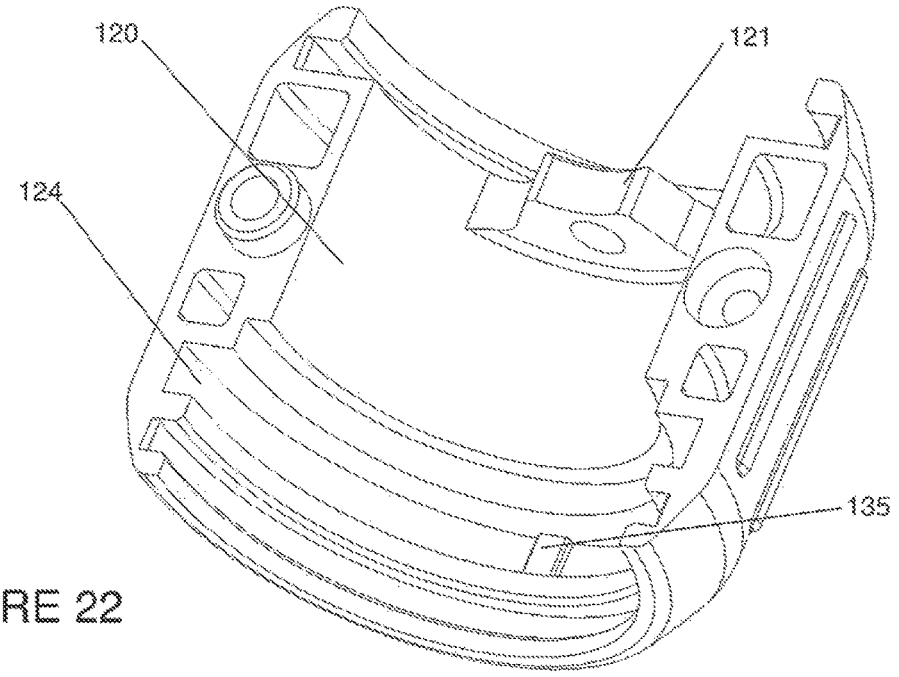
FIG. 22 is an internal isometric view of casing half 120.
Figure 23:
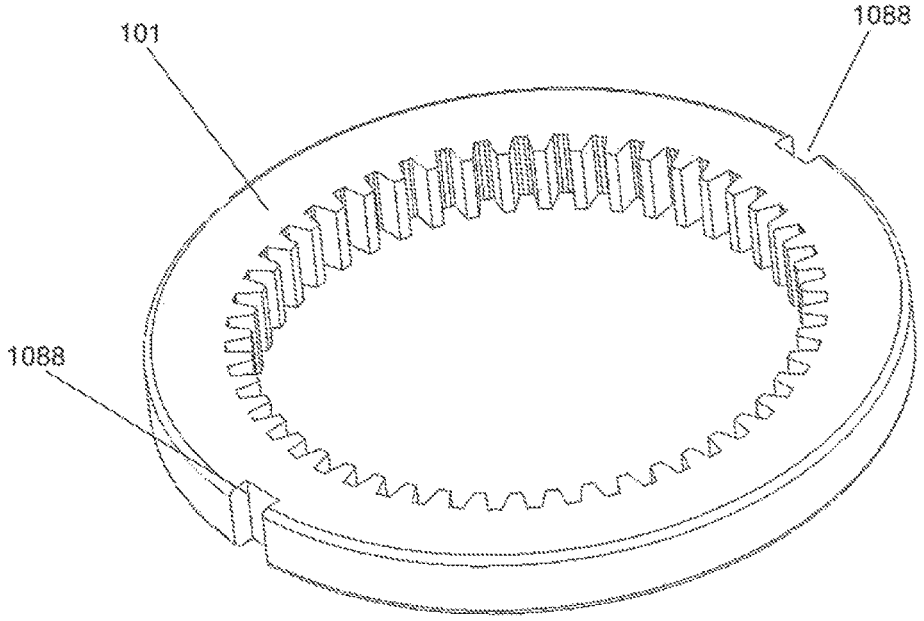
FIG. 23 is an isometric view of ring gear 101.

As shown in the Figures, in one example embodiment, the invention includes casing 120 in the form of a clamshell structure comprised of two halves with symmetrical internal grooves as shown in FIG. 15. The casing 120 supports and houses the planetary gear system and supports the first driving block 109 and second driving block 115. In particular, first rib 122 and second rib 123 shown in FIG. 15 support the first driving block 109 and second driving block 115, respectively. The first driving block 109 and second driving block 115 are shown in a partially assembled screwdriver in FIG. 17 and FIG. 18. First driving block 109 and second driving block 115 are free to rotate on their axes, but they are restricted from translating by first rib 122 and by second rib 123, respectively (see FIG. 15). The middle rib 124 shown in FIG. 15 supports the ring gear 101 as further shown in FIG. 17 and FIG. 18. When the casing is closed as shown in FIG. 20, the ring gear 101 is restricted from any motion independent from the casing 120 by ring lock 135 (shown in FIG. 22) engaging with indents 1088 (shown in FIG. 23). As shown in FIG. 15, on the outer ends of the casing's 120 halves are alignment bores 125 and alignment bosses 126 on opposite sides. These components cooperate to ensure that the two halves of the casing 120 are aligned properly and provide a mechanism to join (e.g., screw) the two halves of casing 120 together. On top of the casing 120 half is a through-hole 106 shown in FIGS. 5, 24, and 25, which allows the locking pin 102 access to the internal gearing structure, including the ring gear 101, sun gear 103, and planetary gears 133.

Figure 8:
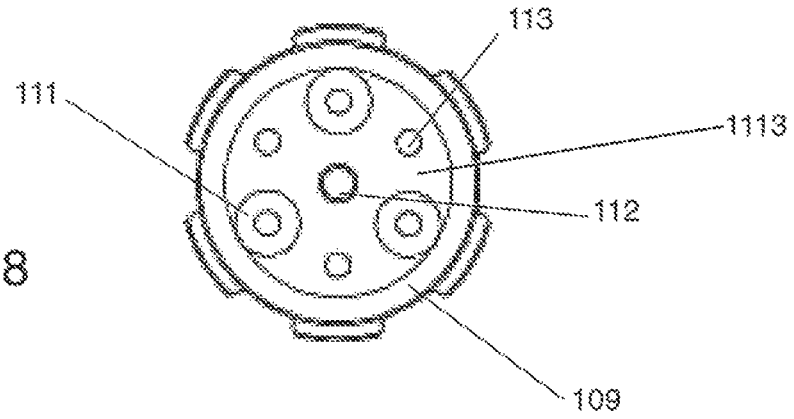
FIG. 8 is a top view of first driving block 109.
Figure 9:
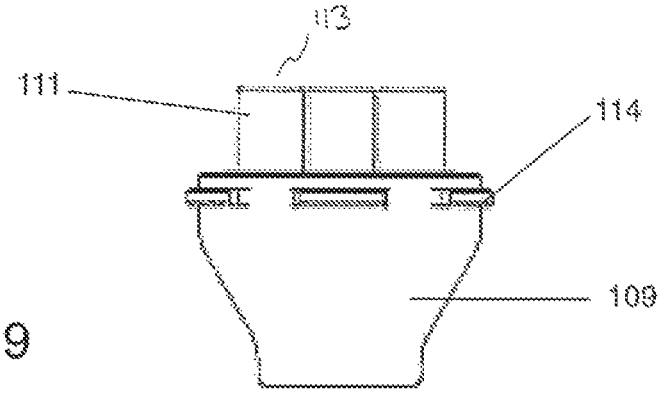
FIG. 9 is a side view of first driving block 109.
Figure 10:
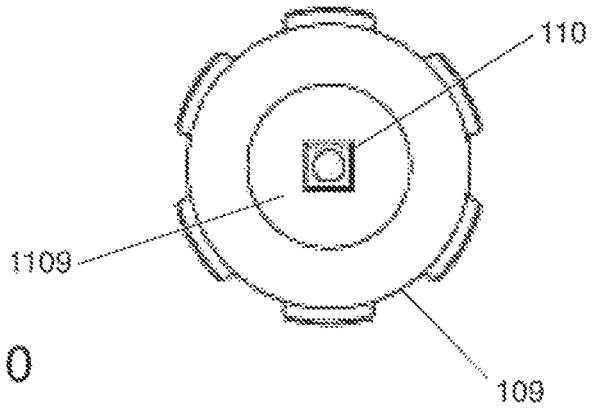
FIG. 10 is a bottom view of first driving block 109.
Figure 18:
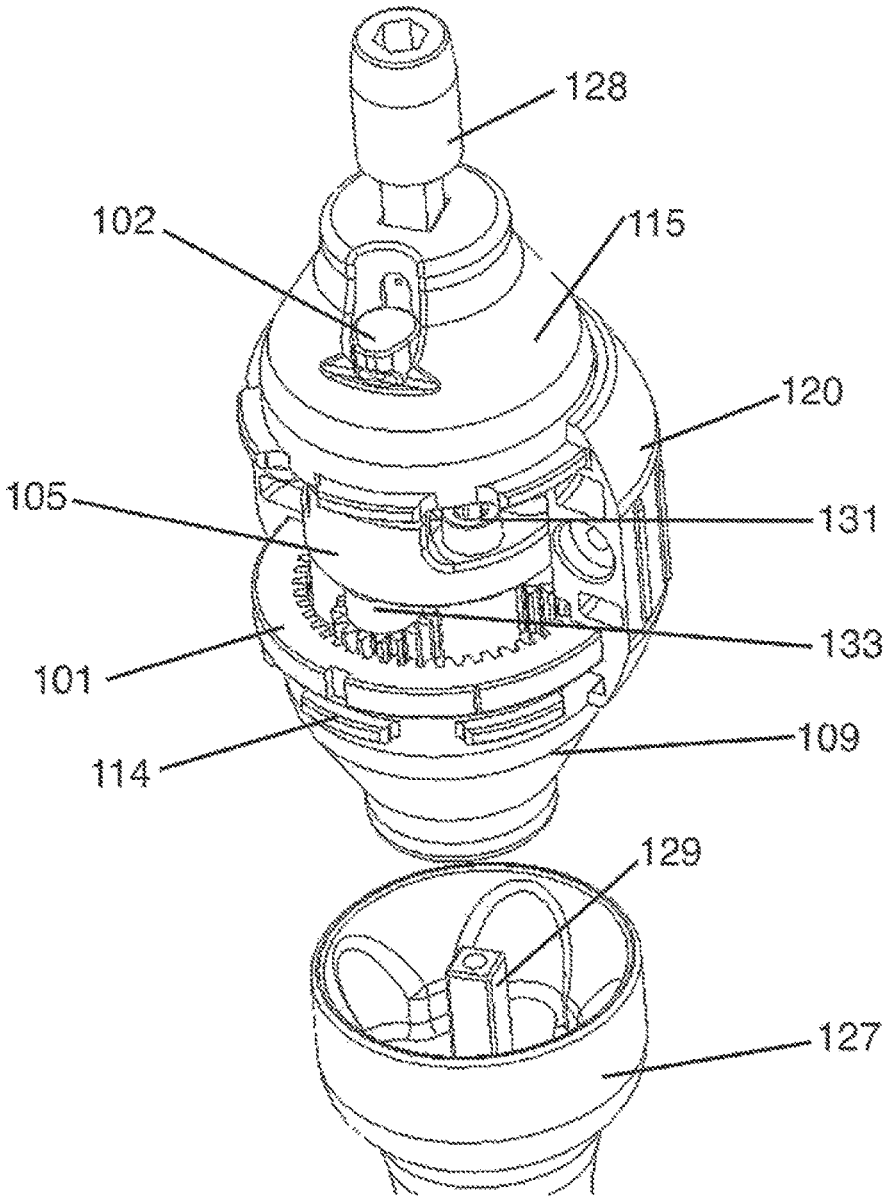
FIG. 18 is an assembly view of an example screwdriver in accordance with the claimed invention with handle male insert 129 exposed.
Figure 19:
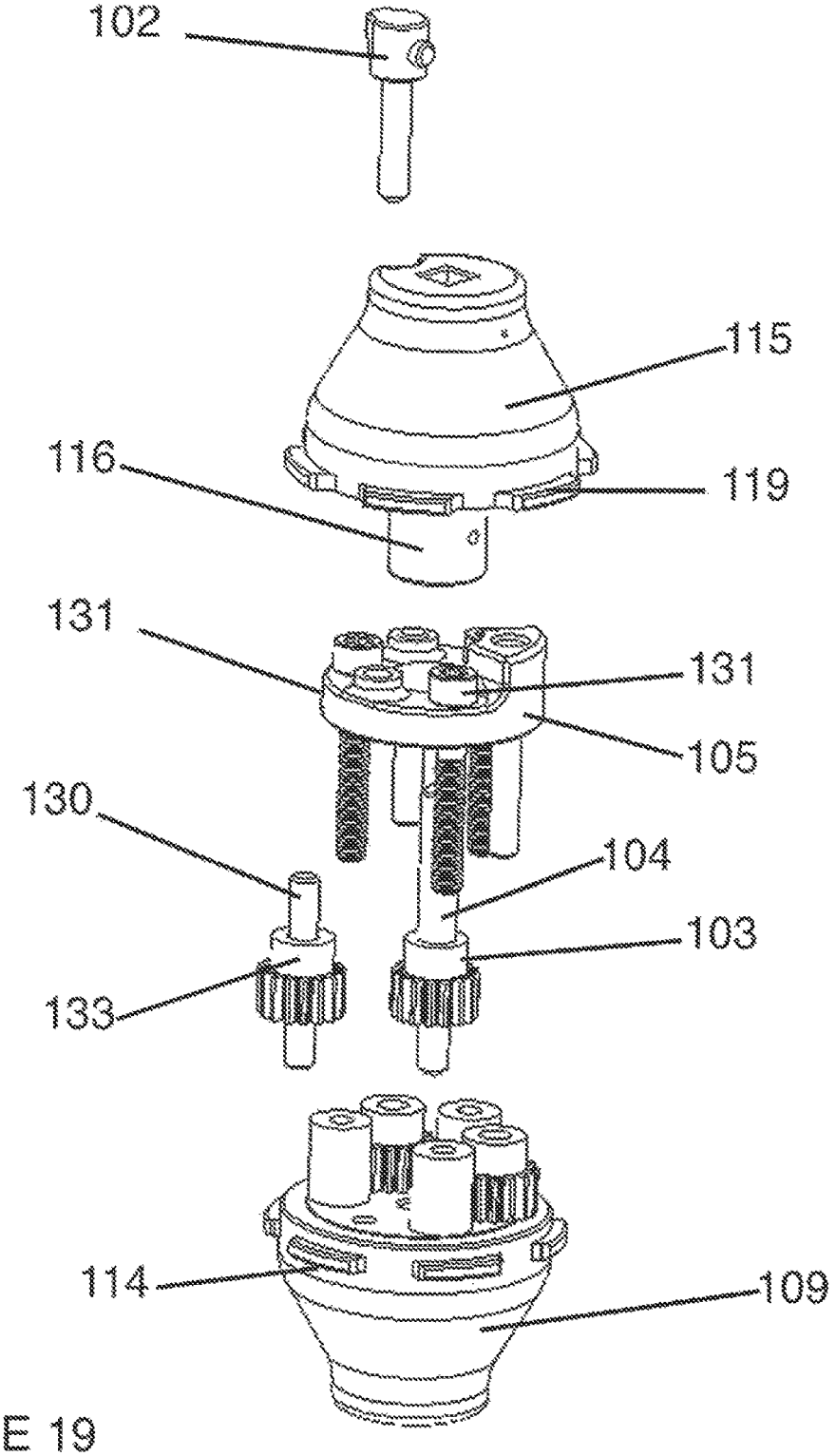
FIG. 19 is an exploded view of internal gearing and support of an example screwdriver in accordance with the claimed invention.

First driving block 109 provides the screwdriver of the claimed invention with both a speed advantage and a torque advantage over conventional screwdrivers. One example first driving block 109 is shown generally as a conical structure in FIG. 9 that acts as the planetary carrier in the planetary gear system. On the top face 1113 of the first driving block 109 shown in FIG. 8, there are three bore holes 113 placed on the circumference of the face 1113. These bore holes 113 receive the support shafts 130 that support the planetary gears 133 as shown in FIG. 19. The boreholes 113 allow the planetary gears 133 to rotate on their own axes. Three extruded bore holes 111 are also placed on the circumference of the face 1113 as shown in FIG. 8. These bore holes 111 receive the support fasteners 131 that attach the support disk 105 (FIG. 7) to the first driving block 109 as shown in FIG. 19. In the center of the top face 1113 is a borehole 112 that supports the sun gear shaft 104. The borehole 112 allows the sun gear 103 to rotate independently of the first driving block 109. At the center of the bottom face 1109 of the first driving block 109 shown in FIG. 10 is an accessory insert 110. The accessory insert 110 allows the attachment of a handle 127 or bit 128 shown in FIG. 18. As also shown in FIG. 9, on the rim of the first driving block 109, there are locking flanges 114 that hold the first driving block 109 in place once enclosed by the casing 120.

Figure 11:
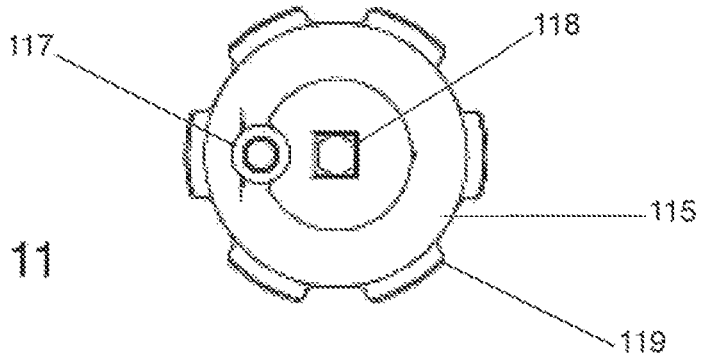
FIG. 11 is a top view of second driving block 115.
Figure 12:
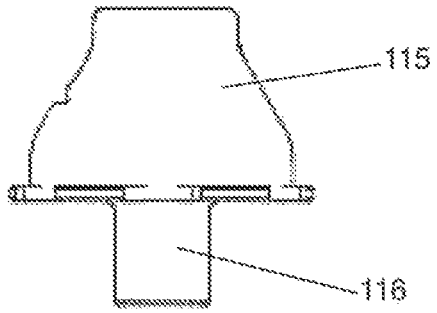
FIG. 12 is a side view of second driving block 115.
Figure 13:
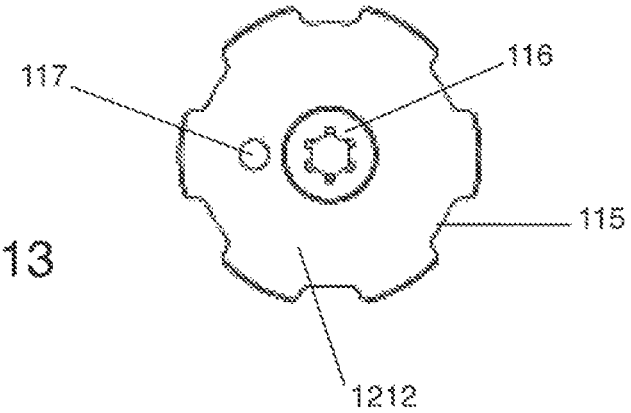
FIG. 13 is a bottom view of second driving block 115.
Figure 14:
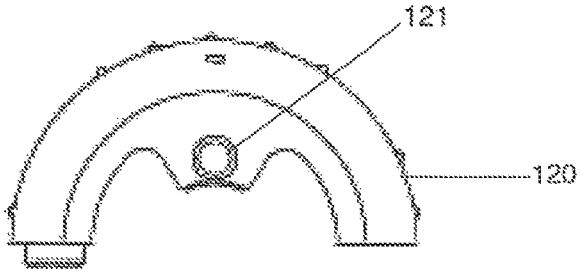
FIG. 14 is a top view of casing half 120.
Figure 16:
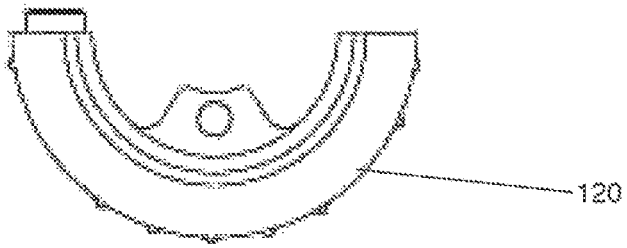
FIG. 16 is a bottom view of casing half 120.
Figure 21:
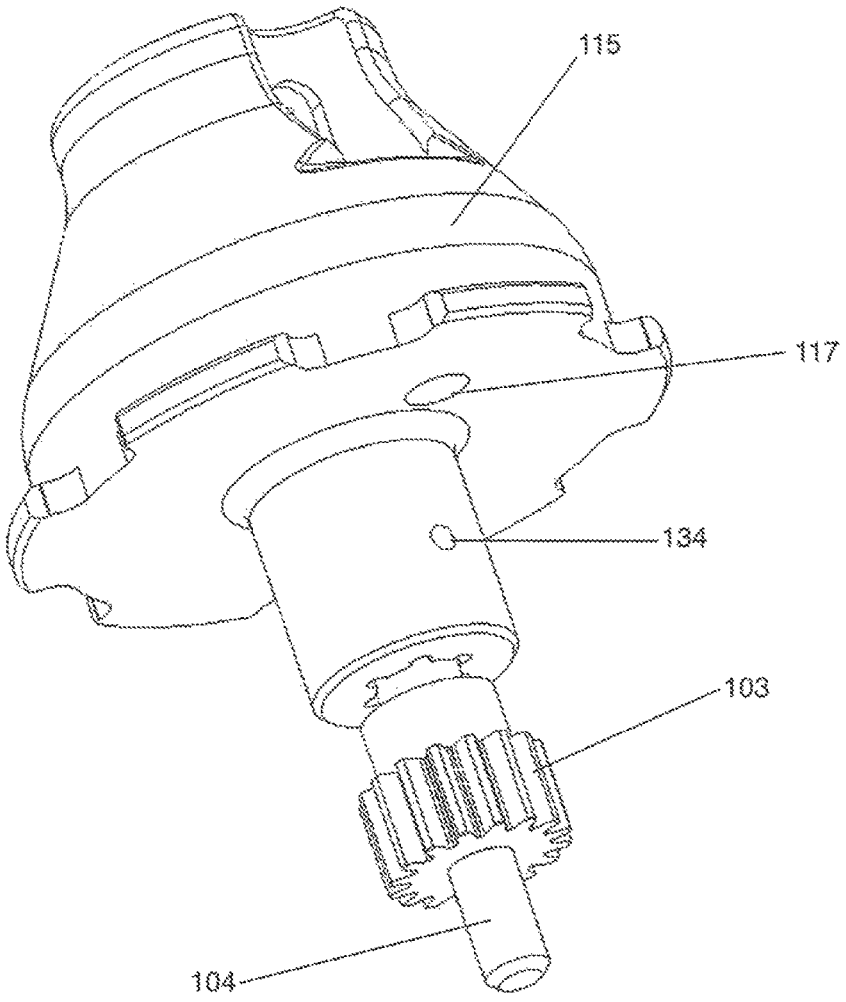
FIG. 21 is a perspective view of sun gear 103 and sun gear shaft 104 mounted on second driving block 115.
Figure 24:
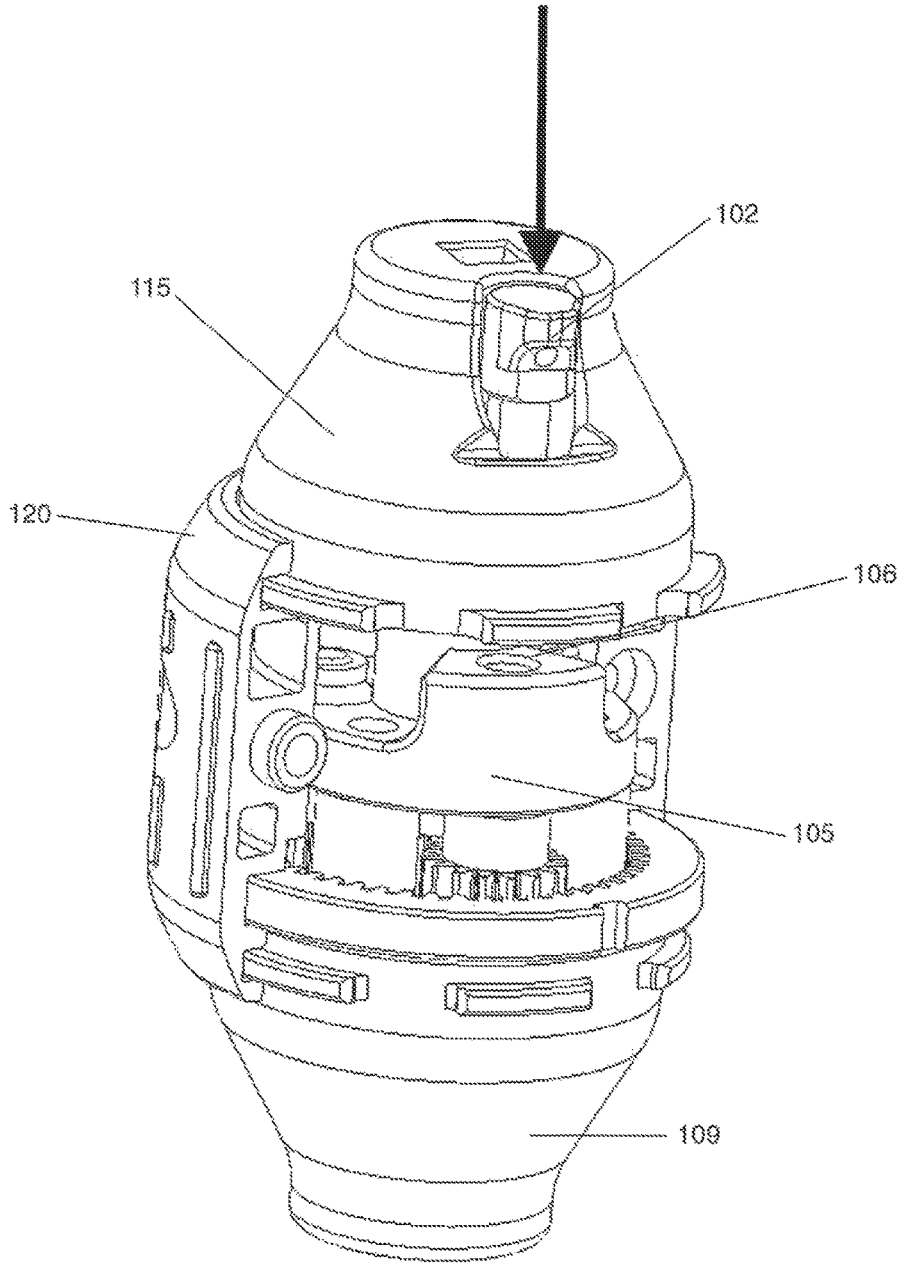
FIG. 24 is an assembly view of an example screwdriver in accordance with the claimed invention without accessory attachments and with internal gearing exposed.
Figure 25:
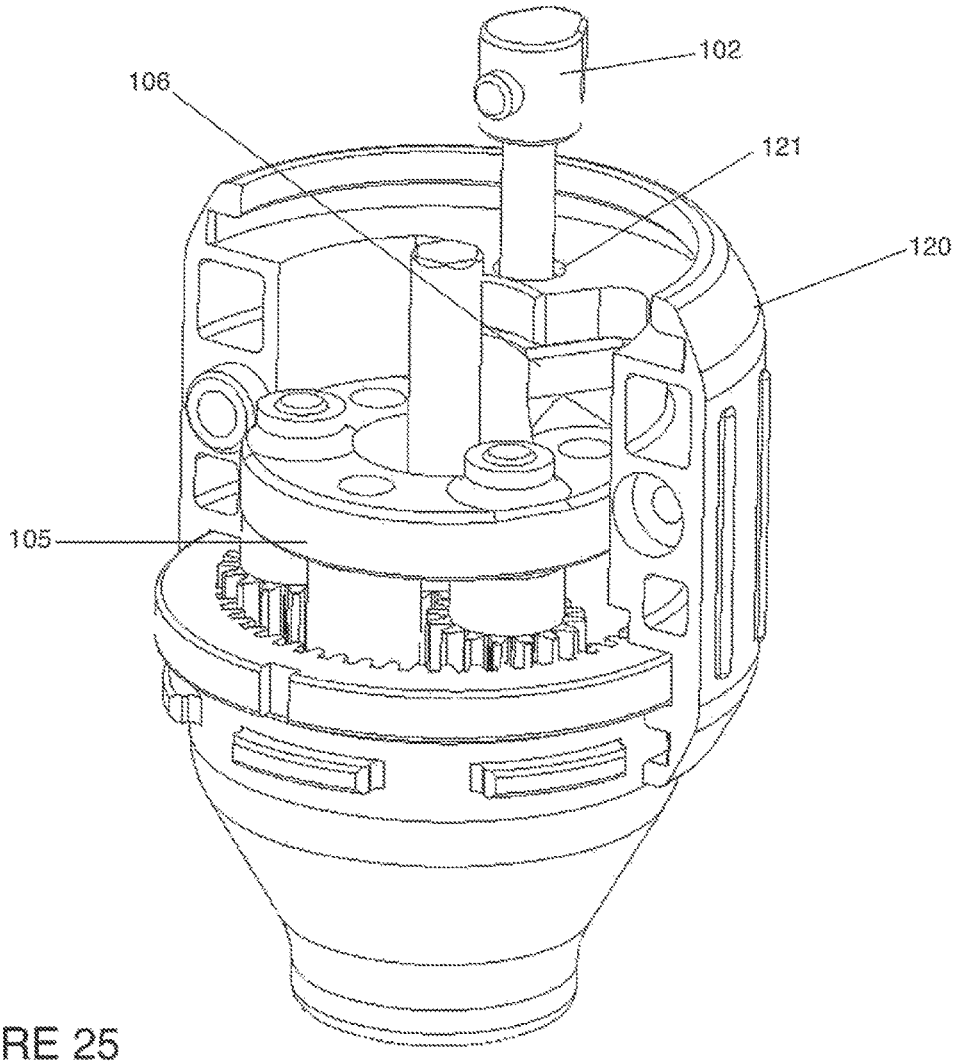
FIG. 25 shows locking pin 102 engaging the internal gearing.

Second driving block 115 in tandem with the first driving block 109 provides both a speed advantage and torque advantage over conventional screwdrivers. One example second driving block 115 is shown as a generally conical structure in FIG. 12 that supports the sun gear shaft 104 (shown also in FIG. 21). At the center of the bottom face 1212 of the second driving block 115 shown in FIG. 13 is an extruded sun gear shaft bore 116. This bore 116 is for the sun gear shaft 104 as shown in FIG. 21. Parallel to this bore 116 is a through-hole that forms locking pin bore 117 in which the locking pin 102 resides. At the center of the top face of the second driving block 115 shown in FIG. 11 is the accessory insert 118. The accessory insert 118 allows attachment of a handle 127 or a bit 128 as shown in FIG. 18. Parallel to the accessory insert 118 is a channel (locking pin bore 117) for the locking pin 102 to slide up and down to engage or disengage the internal gearing (ring gear 101, sun gear 103, planetary gears 133). The locking pin 102 engages when it is slid down the locking pin bore 117 and passes through the locking pin through-hole 121 (shown in FIG. 14 and FIG. 16) on the casing 120 and inserted in the locking pin through-hole 106 on the support disk 105. This prevents the second driving block 115, first driving block 109, and other components of the internal gearing from moving independently. The engagement of the locking pin 102 is illustrated in FIG. 24 and FIG. 25. As also shown in FIG. 11, on the rim of the first driving block 115 are flanges 119 that hold the first driving block 115 in place once enclosed by the casing 120.

Figure 1B:
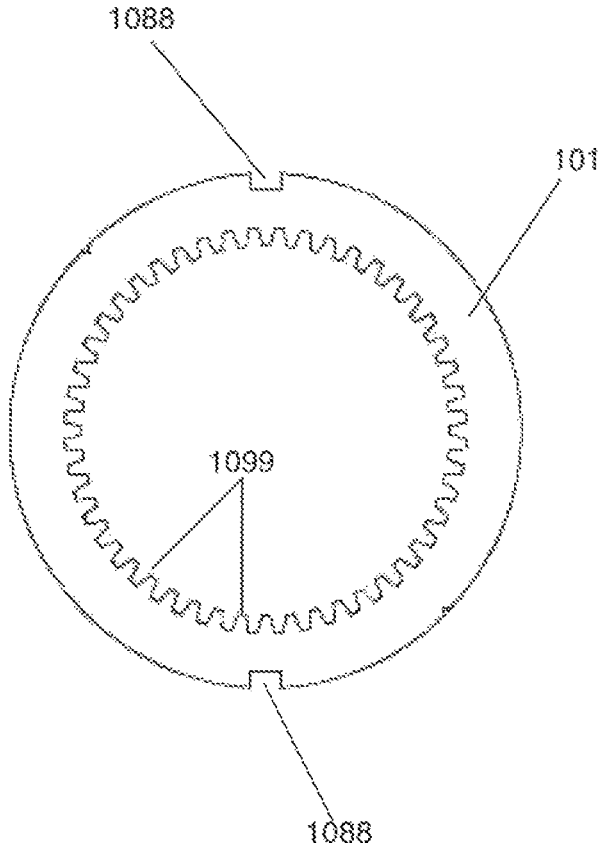
FIG. 1B is a top view of ring gear 101.

The planetary gear screwdriver of the claimed invention includes a planetary gear configuration as shown in FIG. 26. In one example embodiment, the gear system includes a ring gear 101, three planetary gears 133, and a sun gear 103. One example includes three planetary gears 133 rotating about their own axes without linear displacement from their own central axes. One half of the case 120 holds the three planetary gears 133 so that they rotate about their own axes and not about the axis of the support shaft 130 (shown in FIG. 19, for example). The other half of the case 120 holds the planetary gears 133, the ring gear 101, and the sun gear 103. The inner part of this half of the case 120 includes middle rib 124 and is attached to the ring gear 101, which has internally positioned teeth 1099 as shown in FIG. 1B. As this half of the case 120 rotates, the ring gear 101 also rotates, which then rotates the planetary gears 133. The planetary gears 133, in turn, rotate the sun gear 103. Rotation can also be created through sun gear 103, which will then rotate the planetary gears 133 and ring gear 101.

Ring gear 101 is an internal gear cut on a ring-shape rim as shown in FIG. 1B. Two indents 1088 on the outer ring of the gear 101 allow it to lock into place with the middle rib 124 on casing 120 as shown further in FIG. 23.

Figure 3:
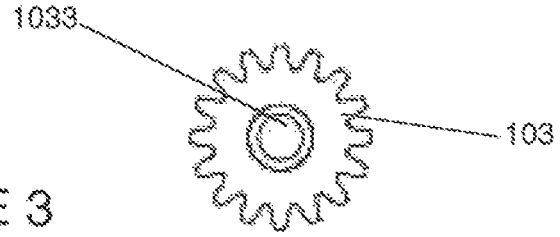
FIG. 3 is a top view of sun gear 103.
Figure 4:
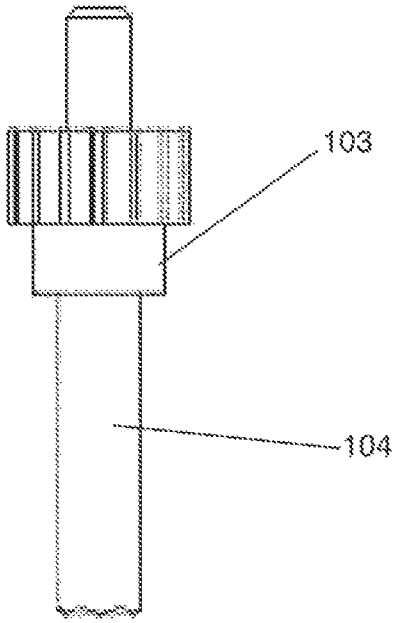
FIG. 4 is a side view of sun gear 103 mounted on sun gear shaft 104.

Sun gear 103 is a spur gear with a bore 1033 that receives the sun gear support shaft 104 with a tight clearance as shown in FIG. 3 and FIG. 4.

Planetary gears 133 can be three identical spur gears that fit the support shafts 130 with a loose clearance as shown in FIG. 19.

Figure 5:
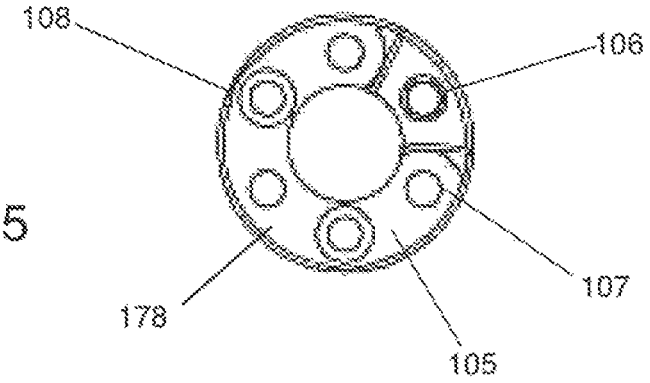
FIG. 5 is a top view of support disk 105.
Figure 6:
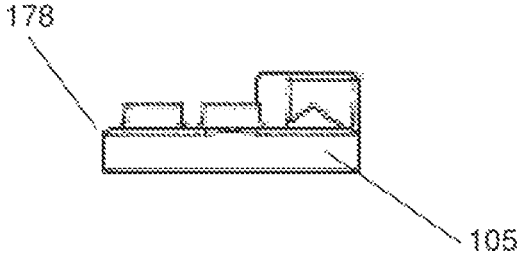
FIG. 6 is a side view of support disk 105.
Figure 7:
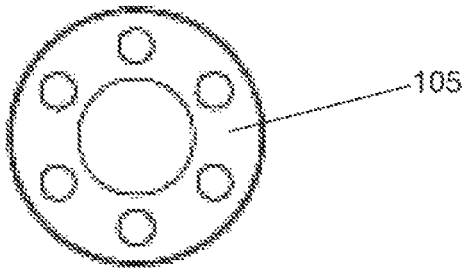
FIG. 7 is a bottom view of support disk 105.
Figure 30:
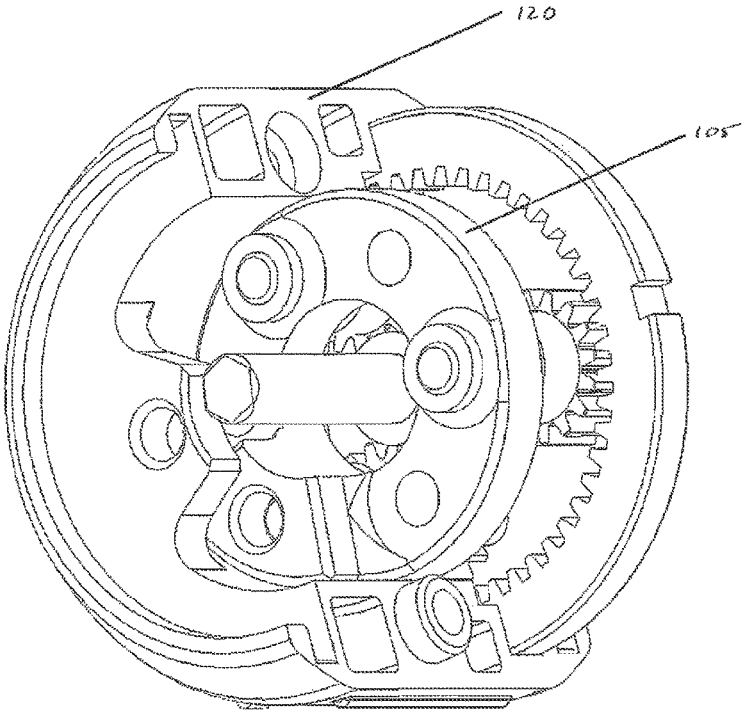
FIG. 30 is a perspective view of the internal gearing and support disk 105 resting inside of casing half 120.

A support disk 105 is shown in FIG. 6 and FIG. 7 and helps support the planetary gears 133 along with the first driving block 109 (see FIG. 30). On the top face 178 of the support disk shown in FIG. 5 are three bores (support shaft through-holes) 108 placed on the circumference of the face 178. These bore holes 108 receive the support shafts that support the planetary gears 133 as shown in FIG. 19. One of these bore holes 108 is extruded further to allow space for the locking pin 102 to engage. Three through-holes 107 are also placed on the circumference of the face as shown in FIG. 5. These through-holes 107 are for the support fasteners 131 that attach the support disk 105 to the first driving block 109 as shown in FIG. 19. The first driving block 109 can be configured and manufactured in this fashion to operate as the planetary carrier in a reversible planetary screwdriver in accordance with the claimed invention. In the center of the face is a through-hole that allows clearance for the sun gear as shown in FIG. 19 and FIG. 27.

Figure 2:
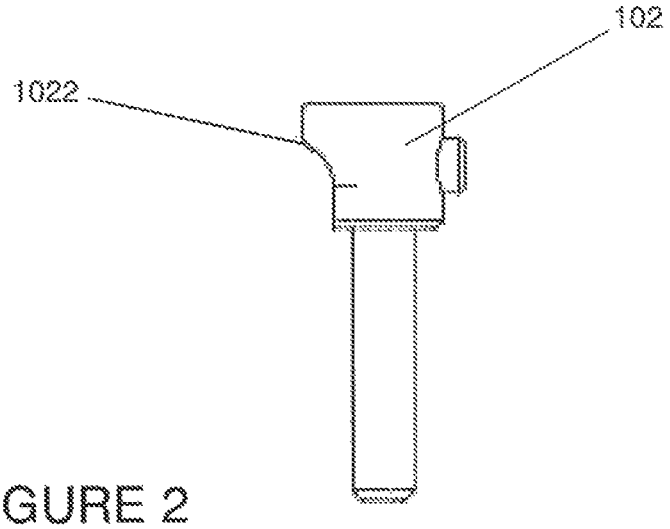
FIG. 2 is a side view of locking pin 102.

A locking pin 102 is shown in FIG. 2 and FIG. 19 with a flange tip 1022 that allows the user to slide the pin 102 up and down an allotted cavity (locking pin through-hole 106) in the support disk 105.

Figure 28:
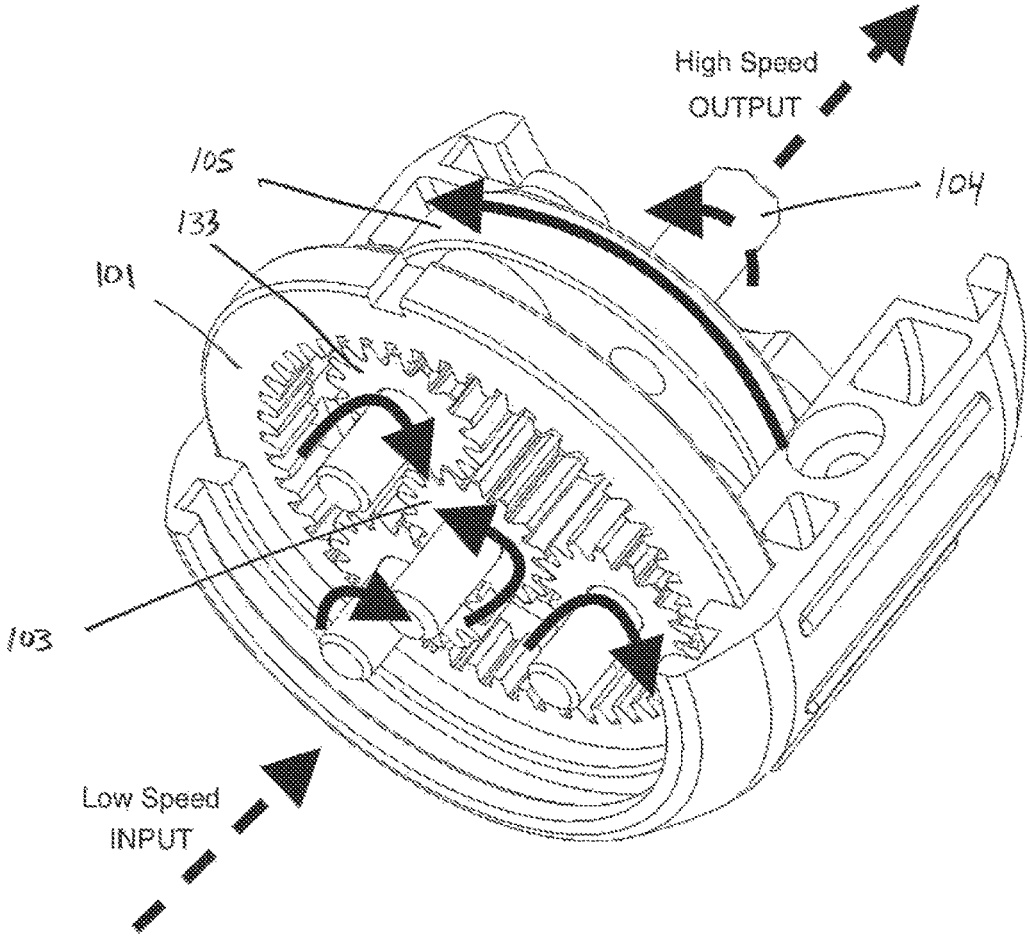
FIG. 28 is a diagram of the movement of the internal gearing while in a speed advantage (slow input-fast output) configuration.

A proper assembly of the internal components of one embodiment of the claimed invention is shown in FIG. 18. The core assembly 210 of the present invention is shown in FIG. 20. There are two configurations of the device that provide separate and complementary advantages. The first configuration, shown in FIG. 28, is slow input speed-fast output speed configuration with handle 127 coupled to the first driving block 109 and the bit 128 coupled with the second driving block 115. In this configuration, the screwdriver provides a speed advantage. When the handle 127 is rotated, the first driving block 109 is rotated with it. The first driving block 109, which also acts as the planetary carrier, transmits the rotation through the gear system. In this configuration, the sun gear 103 provides the output. The sun gear 103 is mounted onto the second driving block 115, and the second driving block 115 is coupled with the bit accessory 128. Therefore, the second driving block 115 and bit accessory 128 rotate synchronously with the sun gear 103. In this planetary gear system, the sun gear's output rotation is at a faster speed than the input rotation speed of the planetary carrier, which is shown in FIG. 28.

Figure 29:
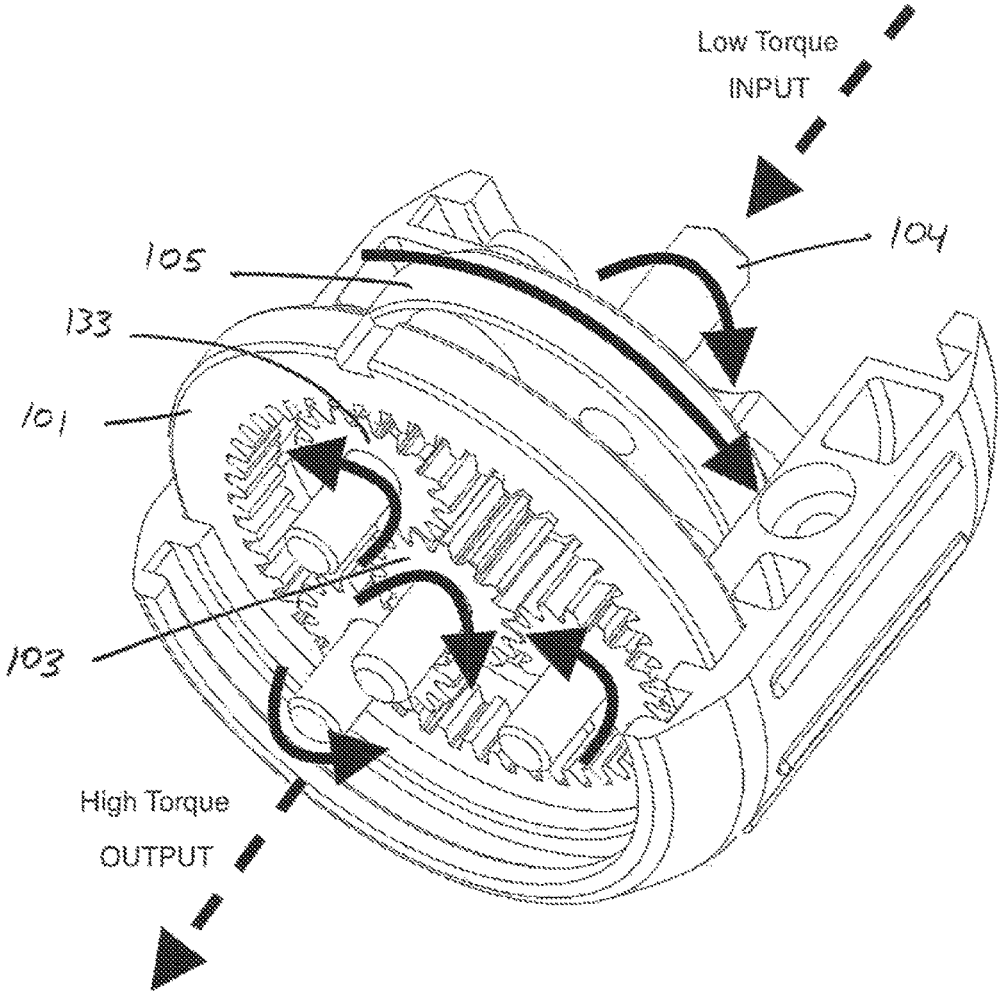
FIG. 29 is a diagram of the movement of the internal gearing while in a torque advantage (low torque input-high torque output) configuration.

FIG. 29 shows a second configuration, which is a low torque input-high torque output configuration, where the handle 127 is coupled with the second driving block adapter 115 and the bit 128 is coupled with the first driving block 109. To switch between the slow input speed-fast output speed configuration to the low torque input-high torque output configuration, a user detaches the handle accessory 127 from the first driving block 109 and detaches the bit accessory 128 from the second driving block 115. The handle accessory 127 is then attached to the second driving block 115, and the bit accessory 128 is then attached to the first driving block 109. Likewise, to switch between the low torque input-high torque output configuration to the slow input speed-fast output speed configuration, the configuration is reversed, and a user detaches the handle accessory 127 from the second driving block 115 and detaches the bit accessory 128 from the first driving block 109. The handle accessory 127 is then attached to the first driving block 109 and the bit accessory 128 is then attached to the second driving block 125. In this low torque input-high torque output configuration, the screwdriver device provides a torque advantage. When the handle 127 is rotated, the second driving block 115 is rotated with it. The second driving block 115, which has the sun gear 103 mounted on it, transmits the rotation through the gear system. In this configuration, the planetary carrier that is also the first driving block 109 provides the output. The first driving block 109 is coupled with the bit accessory 128, therefore the two components rotate synchronously. In this planetary gear system, first driving block's output torque is greater than the input torque provided by the second driving block 115 and sun gear 103, which is shown in FIG. 29. In both configurations, when the locking pin 102 is engaged, the screwdriver operates with a standard one-to-one torque advantage and one-to-one speed characteristic. This can be advantageous when a user is starting a screw or otherwise beginning operation.

When in operation, the casing 120 is grasped with one hand and held in place, which in return grounds (i.e., immobilizes) the ring gear 101 in the planetary gear system. That is, the hold of the middle rib 124 of casing 120 prevents the ring gear 101 from rotating. A user's other hand rotates the handle 127. If the device is in the slow input speed-fast output speed configuration (FIG. 28), the first driving block 109 rotates along with the handle 127, which sequentially rotates the planetary gear system. The end result is the second driving block 115, along with the accessory bit 128 both rotate at a higher speed as shown in FIG. 28.

If the device is in the low torque input-high torque output configuration, the second driving block 115 rotates along with the handle accessory 127, which sequentially rotates the planetary gear system. The end result is the first driving block 109, along with the accessory bit 128 both rotate with a higher torque output as shown in FIG. 29.

If the locking pin 102 is engaged, it is no longer necessary to grasp the casing 120 with one hand. The locking pin 102 slides into designated slots, which binds the planetary gear system and prevents any internal rotation. The device is then operated as if it was a conventional screwdriver.

The claimed invention is:

1. A reversible planetary gear driver tool for driving and removing fasteners, the driver tool comprising:

a first driving block including a locking flange and an accessory insert, the first driving block configured as a planetary gear carrier, and the accessory insert configured to receive a handle or a bit;

a planetary gear set in cooperation with the first driving block, the planetary gear set including:

a ring gear having an inner diameter and gear teeth disposed on an inside surface of the ring gear;

a sun gear positioned in substantially the center of the ring gear and having an exterior diameter and gear teeth disposed on an outside surface of the sun gear;

a planetary gear positioned within the ring gear, the planetary gear engaging the gear teeth of the ring gear and the gear teeth of the sun gear; and a support disk in cooperation with the planetary gear set, the support disk including a fastener configured to attach the support disk to the planetary gear set;

a second driving block including a locking flange and a bit accessory insert, the bit accessory insert configured to receive the bit or the handle;

a locking pin extending from the second driving block, the locking pin configured to lock the planetary gear set in an in-position and configured to allow the planetary gear set to rotate when positioned in an out-position;

a casing configured to couple the first driving block, the planetary gear system, and the second driving block, the casing including:

a first rib that supports the first driving block;

a second rib that supports the second driving block;

a middle rib that supports the ring gear such that when the casing is closed, the ring gear is grounded;

wherein when a handle is engaged with the accessory insert of the first driving block and a bit is engaged with the bit accessory insert of the second driving block and the casing is prevented from rotating, the first driving block is rotated at a first speed, and the reversible driving tool converts the first speed of the first driving block to a faster second speed of the second driving block; and when the casing is reversed and the handle is engaged with the bit accessory insert of the second driving block and the bit is engaged with the accessory insert of the first driving block and the second driving block is rotated at a first torque, the reversible driving tool converts the torque of the second driving block to a higher torque of the first driving block.

2. The planetary gear driver tool of claim 1 further comprising:

a sun gear shaft in cooperation with the sun gear and extending from the sun gear to the bit accessory insert in the second driving block.

3. The planetary gear driver tool of claim 1, wherein the first driving block extends from the planetary gear system to the accessory insert.

4. The planetary gear driver tool of claim 1, wherein the support disk includes a locking pin through-hole configured to receive the locking pin when the locking pin is in the in-position.

5. The planetary gear driver tool of claim 4, wherein the casing includes a locking pin casing through-hole configured to receive the locking pin when the locking pin is in the in-position.

6. The planetary gear driver tool of claim 1 further comprising:

a handle including an input insert configured to be received by the accessory insert of the first driving block.

7. The planetary gear driver tool of claim 6, wherein the handle includes a locking pin recess, the locking pin recess configured to receive a flange tip of the locking pin.

8. The planetary gear driver tool of claim 6, wherein the handle includes a T-shaped grip.

9. The planetary gear driver tool of claim 6, wherein the handle includes a longitudinal cavity configured to reversibly receive the first driving block to provide a speed configuration of the planetary gear driver tool or the second driving block to provide a torque configuration of the planetary gear driver tool.

10. The planetary gear driver tool of claim 6, and wherein the input insert is positioned substantially in the center of the longitudinal cavity of the handle.

11. The planetary gear driver tool of claim 1, wherein the bit attachment includes at least one of a slot head screw driver, a Phillips head screw driver, a square drive attachment, a hex drive attachment, and a six-point star-shaped pattern drive attachment.

12. The planetary gear driver tool of claim 1, wherein the planetary gear set further comprises a plurality of planetary gears.

13. The planetary gear driver tool of claim 1 further comprising:

an output shaft configured to extend longitudinally from the accessory insert or from the accessory bit insert and configured to receive a bit attachment.

14. The planetary gear driver tool of claim 13, wherein the bit attachment includes at least one of a slot head screw driver, a Phillips head screw driver, a square drive attachment, a hex drive attachment, and a six-point star-shaped pattern drive attachment.

* * * * *